US012098486B2

(12) United States Patent
Gerth et al.

(10) Patent No.: US 12,098,486 B2
(45) Date of Patent: Sep. 24, 2024

(54) DEVICE AND METHOD FOR HANDLING HARNESS ELEMENTS

(71) Applicant: Groz-Beckert KG, Albstadt (DE)

(72) Inventors: Christian Gerth, Meersburg (DE); Stefan Kailer, Meßstetten (DE); Bernd Pfeffer, Haigerloch (DE); Michael Acker, Albstadt (DE); Karl-Heinz Gesing, Raesfeld (DE)

(73) Assignee: GROZ-BECKERT KG, Albstadt (DE)

( * ) Notice: Subject to any disclaimer, the term of this patent is extended or adjusted under 35 U.S.C. 154(b) by 309 days.

(21) Appl. No.: 17/620,320

(22) PCT Filed: Jun. 4, 2020

(86) PCT No.: PCT/EP2020/065441
§ 371 (c)(1),
(2) Date: Dec. 17, 2021

(87) PCT Pub. No.: WO2020/254118
PCT Pub. Date: Dec. 24, 2020

(65) Prior Publication Data

US 2022/0243369 A1 Aug. 4, 2022

(30) Foreign Application Priority Data

Jun. 19, 2019 (EP) ..... 19181184

(51) Int. Cl.
*D03J 1/14* (2006.01)

(52) U.S. Cl.
CPC ..... *D03J 1/14* (2013.01)

(58) Field of Classification Search
None
See application file for complete search history.

(56) References Cited

U.S. PATENT DOCUMENTS 4,760,628 A * 8/1988 Kaufmann ..... D03J 1/14 28/208
5,136,762 A 8/1992 Gironi
(Continued)

FOREIGN PATENT DOCUMENTS

CH 685203 A5 4/1995
CN 101613905 A 12/2009
(Continued)

OTHER PUBLICATIONS

China National Intellectual Property Administration; Second Office Action in corresponding Patent Application No. 202080044453.8 dated Mar. 4, 2023; 20 pages.
(Continued)

*Primary Examiner* — Grace Huang
(74) *Attorney, Agent, or Firm* — Fitch, Even, Tabin & Flannery LLP

(57) ABSTRACT

A device and a method for handling weaving accessories is described herein. A first holding element is provided for being moved cyclically between a supply device and a receiving device. The first holding element is disposed at a carrier means. A push-off element for pushing a weaving accessory off the holding element and onto a component of the receiving device is also disposed at the carrier means. The first holding element is preferably provided for performing its cyclic movement in a plane with an axis running at right angles thereto.

16 Claims, 2 Drawing Sheets

(56) References Cited

U.S. PATENT DOCUMENTS

| | | | | |
|---|---|---|---|---|
| 5,282,299 | A * | 2/1994 | Tachibana | D03J 1/14 28/208 |
| 5,287,605 | A * | 2/1994 | Badertscher | D03J 1/14 28/207 |
| 11,668,028 | B2 * | 6/2023 | Gesing | D03J 1/14 28/202 |

FOREIGN PATENT DOCUMENTS

| | | | |
|---|---|---|---|
| CN | 103924365 | A | 7/2014 |
| CN | 107740214 | A | 2/2018 |
| CN | 114008257 | A | 2/2022 |
| DE | 69008100 | T2 | 11/1994 |
| EP | 3754070 | A1 | 12/2020 |
| JP | 2009249751 | A | 10/2009 |
| WO | 92/05303 | A1 | 4/1992 |
| WO | 00/11252 | A1 | 3/2000 |

OTHER PUBLICATIONS

Extended European Search Report dated Nov. 19, 2019, in corresponding European Application No. 19181184.3, with machine English translation.

International Search Report and Written Opinion dated Sep. 14, 2020, in corresponding International Application No. PCT/EP2020/065441, with machine English translation.

SIPO First Office Action and Search Report for Publication No. CN 202080044453.8 dated Aug. 18, 2022, 9 pages.

European Patent Office; Examination Report in corresponding European Patent Application No. 19181184.3-1017, dated Nov. 23, 2022; 16 pages.

National Intellectual Property Administration, P.R. China; Supplementary Search Report in corresponding Chinese Application No. 202080044453.8, dated Jun. 8, 2023; 2 pages.

Japan Patent Office; Reasons for Refusal in corresponding Japanese Patent Application No. 2021-576130, dated Mar. 27, 2024; 6 pages.

* cited by examiner

DEVICE AND METHOD FOR HANDLING HARNESS ELEMENTS

CROSS REFERENCE TO RELATED APPLICATIONS

This patent application is the national phase of PCT/EP2020/065441, filed Jun. 4, 2020, which claims the benefit of European Patent Application No. 19181184.3, filed Jun. 19, 2019.

TECHNICAL FIELD

The present invention relates to a device, such as a drawing-in machine, for handling weaving accessories and a method for handling weaving accessories.

BACKGROUND

A drawing-in machine is a machine for drawing threads or warp threads into weaving accessories. It can be broken down into various functional units and has corresponding devices and components thereof. These include, for example, devices for the supply of healds and drop wires, through which the threads will be drawn. In these supply devices, the weaving accessories are suspended contiguously on rail-like guideways, as is generally the case, for example, for sales purposes or during weaving. On the "loading side", additionally, a device is needed for holding a reed in readiness. The central device in a drawing-in machine is a drawing-in device that typically guides the threads through reed, heald, drop wire and through components of a lease. On the "unloading side", the drawn-in drop wires and healds have to be transported away from the vicinity of the drawing-in device in order to prevent backward congestion. In the drawing-in device, healds and drop wires are mostly transported fast over short distances in order to achieve a high drawing-in repetition rate. After being drawn in, the weaving accessories have to be pushed over mostly lengthy, rail-like guideways. Their removal is mostly slow, although the weaving accessories have to travel relatively large distances. These are typically 2 to 3 m, but sometimes distances of up to 6 m are required. On the "unloading side", drop wires and healds are often transported away parallel, in devices arranged beside each other. The present invention focuses on the transport of weaving accessories from a supply device to the drawing-in device and on to the receiving device. The invention relates advantageously to a module for the transport of healds, but drop wires are not excluded.

The DE69008100T2 describes a drawing-in machine that guides healds on strip-like rails and transports and positions them by means of various rams or pushers. A rotatable rail makes it possible, if desired, to select the transport direction for pushing off the weaving accessory onto a predetermined heald frame. A ram is guided along the rotatable rail by means of complex guideways, which are subject to a high level of wear.

The WO9205303A1 discloses a drawing-in machine in the case of which numerous holding means for healds are mounted at regular intervals on a carrier. After being separated, a heald remains on the same holding means from drawing-in until push-off. This practice is intended to enhance the reliability of the drawing-in machine and to enable a modular construction. Each rail onto which a heald could be pushed is assigned an individually controlled push-off actuator

SUMMARY

Starting from the above-cited prior art, the aim of the present invention is to provide a device for handling weaving accessories and a method for handling weaving accessories, which offers the greatest possible reliability in the handling of weaving accessories and yet is of simple construction.

The device according to the invention for handling weaving accessories comprises a first holding element. The first holding element is provided for being moved cyclically between a supply device and a receiving device. The first holding element is disposed at a carrier means. The carrier means carries the holding element. When the carrier means moves, the holding element arranged at the carrier means also moves. A push-off element for pushing a weaving accessory off the holding element and onto a component of the receiving device is also disposed at the carrier means. The first holding element is preferably provided for performing its cyclic movement in a plane with an axis running at right angles thereto.

Integration of a push-off element in a carrier device for a holding element enables the push-off element to eject a weaving accessory held to the holding element with a high level of reliability. At the same time, integration of a push-off element makes for a simple device construction requiring only a small number of actuators.

The holding element may be of pencil-shaped or rod-shaped configuration. The holding element may be provided for engaging an end loop of a weaving accessory, in particular of a heald. The holding element may have a longitudinal extension which at least suffices for it to pick up a weaving accessory reliably, taking all tolerances into consideration. The holding element may consist of a steel in order to prevent rapid wear due to contact with the weaving accessories.

A supply device may comprise one or more rail-like components for providing weaving accessories ready for drawing in. The supply device may comprise one or more compartmentalization means for singling out weaving accessories. The supply device may be a component of a heald module.

Among other uses, a carrier means is provided for initiating the movement of the holding element by being operatively connected to an actuator. It is advantageous for the carrier means to be disposed rotatably around an axis. The path line of the first holding element's cyclic movement may follow a circular path enclosing a circular surface and an axis may be defined by the mid-vertical on the circular surface. The carrier means may be driven by an electric motor. If there is more than one carrier means, to each carrier means may be assigned its own separate electric motor.

The push-off element may be disposed movably relative to the carrier means by means of a mechanical actuator disposed at the carrier means. The push-off element may comprise a pretensioning element which is arranged such that, with the aid of the pretensioning element, the push-off element can be moved by a stationary device member into a retracted position relative to the carrier means when the carrier means is moved past the stationary device member. By means of this configuration, a mechanical stress is built up in the mechanical actuator when the carrier means moves past the stationary device member. The push-off element may comprise a mechanical actuator formed by a spring. The spring may be pretensioned, for example by the movements the carrier means has to make anyway relative to the stationary device member.

The push-off element may be disposed at the carrier means for being lockably in a retracted position. Preferably, the push-off element is locked automatically on pretensioning, for example by means of a mechanical form fit that engages when the push-off element reaches its retracted position. In the case of carrier means provided for performing a rotary movement, the stationary device element preferably has a contact surface for a pretensioning element of the carrier means, whose distance with respect to a common axis increases or decreases in order to deflect the pretensioning element as it moves past in radial direction and, in this way, to pretension a mechanical actuator, preferably an extension spring or a compression spring. The pretensioning element may be provided integrally with the push-off element or disposed immovably at the push-off element.

The carrier means may comprise a release element which is disposed in such a manner that, when the release element is displaced relative to the carrier means, the push-off element is unlocked and able to perform a push-off movement driven by the mechanical actuator. Preferably, the release element is disposed at the carrier means pretensioned by a spring in order to automatically lock the push-off element by means of a form fit when the push-off element, driven by the pretensioning element, reaches a retracted position.

A releaser element may be disposed in such a manner that the displacement of the release element of the carrier means can be effected by the releaser element (12), which is disposed movably relative to the carrier means (6, 7), in the direction of the axis (14). The releaser element may be configured additionally in such a manner that the release element of the carrier means, which is located at an arbitrary component of the receiving device, can be displaced. Displacement of the release element preferably disengages the form fit created during pretensioning so that the push-off element is unlocked and, driven by the tension in the mechanical actuator, moves towards its extended position. It is advantageous for the aforementioned releaser element to act simultaneously for carrier means located at arbitrary components of a handling device, such as the receiving device, thereby keeping the number of parts small and promoting profitability and reliability This can be realised, in the case of carrier means that rotate about a common axis, in such a way that the releaser element has, in the rotational direction of the carrier means, an angular extension that enables it to reach a release element of a carrier means at every possible angular position of the carrier means. A releaser element of this kind may extend as an arc and, in particular, as a circular arc. A releaser element of this kind may act, relative to an axis, at a radial distance corresponding to the radial distance of the release element from a rotation centre of the carrier means. The releaser element preferably acts in a direction parallel to the axis. The releaser element preferably acts on the carrier means from the side opposite the direction of a weaving accessory held to the carrier means.

A detent may be disposed at the carrier means, which opposes the push-off movement of the push-off element in the area of its final extended position. Additionally, the detent is disposed to be able to force the push-off element back from the final extended position of its push-off movement. By means of the detent, the push-off element can be prevented from coming into contact again with weaving accessories that have already been pushed off. The reliability is thereby enhanced still further. It is preferable if the detent has a spring assigned to it, which is compressed by the impacting push-off element, and the push-off element is driven back from its final position by spring force. The push-off element may be forced back from its final position by the detent for a maximum of 10% or 20% of the distance of the push-off movement.

The device may comprise, assigned to the first holding element, a complementary holding element, which is spaced from the first holding element along the axis. The first holding element and/or the complementary holding element may be disposed movably at the carrier means so that a weaving accessory can be held, under tensile stress, between the first holding element and the complementary holding element. In this way, disruptive movements of the weaving accessories between the holding elements are at least partially suppressed and the reliability of the device is enhanced. The distance along the axis is adjustable and can be matched to the length of a weaving accessory. A movable holding element is preferably arranged at a carrier means in such a way that the weaving accessory is in the pretensioned state when no external force is acting.

It is advantageous if the device comprises a detensioner element which is able to effect a displacement of the holding element or of a detensioning pressure element assigned to the holding element. The displacement is preferably parallel to the direction of the axis. A complementary holding element disposed movably at the carrier means may be arranged swingably at the carrier means around a bearing axis of the holding element. The detensioner element may, like the releaser element, extend angularly in such a manner that a holding element at any component of the receiving device can be displaced. An additional detensioner element, which works in the same way, may be assigned to the supply device. The direction of the displacement of the detensioner element is the same as for the releaser element. In particular, the detensioner element and the releaser element may be provided for integrally at the receiving device, thereby reducing the number of parts and enhancing the reliability. It is preferable, however, for the detensioner element to act before the releaser element.

The device according to the invention may be, in particular, a module, such as a heald module, of a modular drawing-in machine. The module can preferably be separated, both mechanically and electrically, from the drawing-in machine without impairing the operation of the other modules. According to a preferred embodiment, the module can also perform its tasks if other modules have been deactivated or even deinstalled. The heald module's supply device may have one or more components at which the holding element can take over a heald from a stack. The holding element is able to move a weaving accessory, such as a heald, to various handling devices. These may include a drawing-in device, a measuring device, a labelling device, an ejection device or other devices. A drawing-in machine may serve to draw a thread through a thread eye of a heald. Healds may be categorized according to their quality by means of a measuring device, and, for example, labelled accordingly if necessary, (labelling device) or rejected (ejection device). Typically, healds into which a thread has been drawn are pushed off onto one of usually several separate components of a receiving device. These components of a receiving device may be carrier rails of heald frames or rail-like guideways assigned to such carrier rails. The receiving device may be a component of a drawing-in machine. The receiving device may be a component of a weaving-accessory trolley.

In carrying out the method according to the invention for handling weaving accessories, a first holding element moves cyclically between a supply device and a receiving device.

The first holding element is configured to perform its cyclic movement in a plane with an axis running at right angles thereto. The first holding element is disposed at a carrier means. The carrier means effects the movement of the holding element by being operatively connected to an actuator. According to the invention, a push-off element, which is also disposed at the carrier means, pushes off a weaving accessory held at the carrier means onto a component of the receiving device.

On account of the simultaneous movement of the holding element holding the weaving accessory and the push-off element, the weaving accessories are pushed off highly reliably and the construction is particularly simple, with only a few parts needing to be controlled. Push-off cannot fail on account of the holding means not positioning the weaving accessory correctly in front of a push-off element assigned to a component of a receiving device or on account of a corresponding push-off element not being correctly triggered.

The first holding element preferably moves on a path line enclosing a circular surface and an axis is defined by the mid-vertical on the circular surface.

The carrier means of the first holding element can move past a stationary device element in order to displace the push-off element relative to the carrier means.

A releaser element can move, in the direction of the axis, relative to the carrier means disposed at a component of the receiving device and displace a release element, which is arranged at the carrier means, relative to the carrier means so that the push-off element pushes off a weaving accessory held to the holding element onto a component of the receiving device.

At the supply device, the first holding element and/or the complementary holding element may be displaced in the direction parallel to the axis by a detensioner element, thereby enabling a weaving accessory to be picked up.

DETAILED DESCRIPTION

Figure 1:
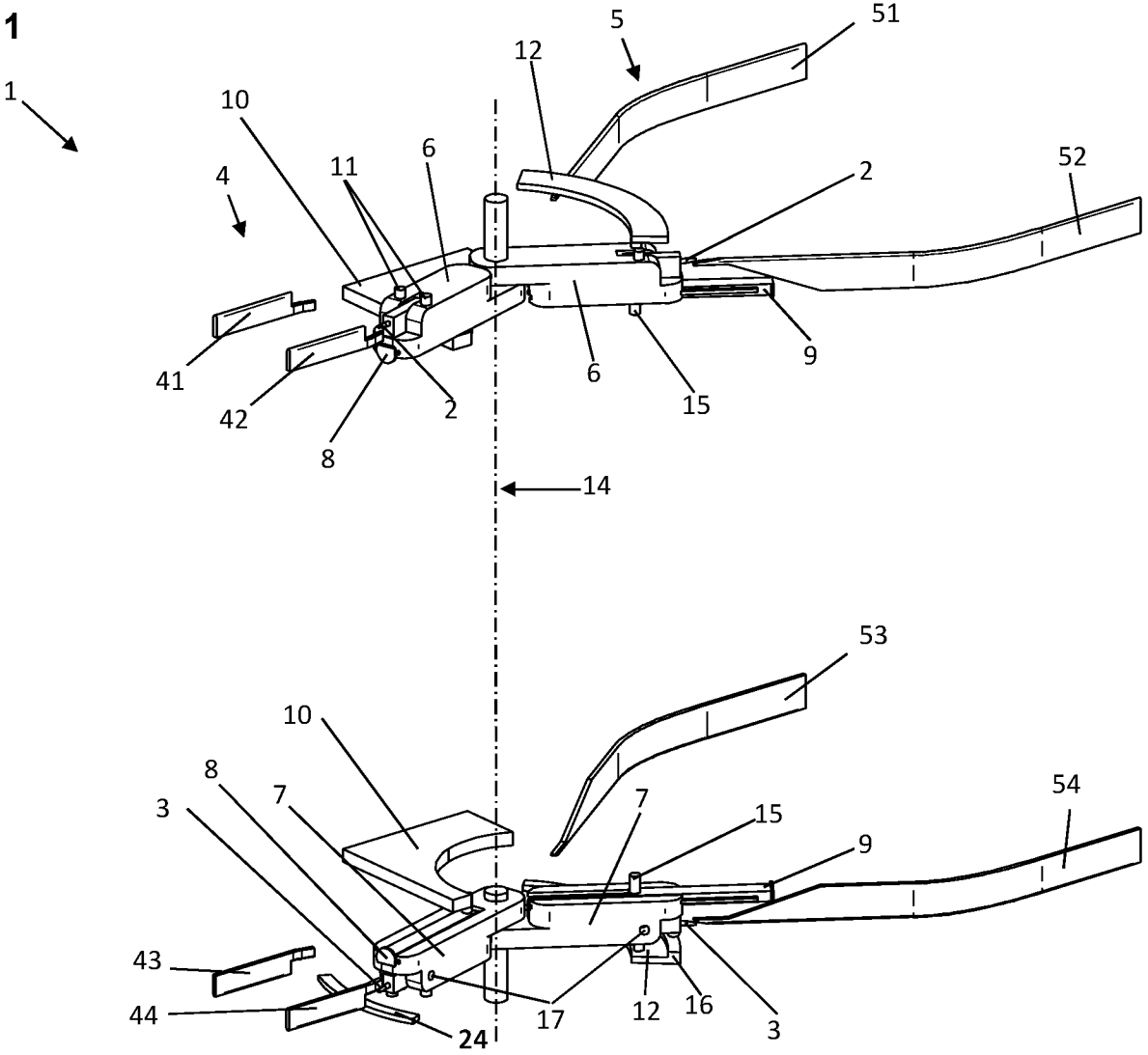
FIG. 1 shows a symbolic oblique view of essential components of the device according to the invention.

FIG. 1 shows a symbolic oblique view of major components of the device 1 according to the invention. Along the axis 14, in an upper area of the device 1, the holding element 2 is shown in two different positions. In a lower area of the device 1, the complementary holding element 3 is shown in two different positions. The holding elements 2 and 3 are provided for transporting non-portrayed weaving accessories from a supply device 4 on the left in FIG. 1 to a receiving device 5 on the right in FIG. 1. The supply device 4 comprises two components 41 and 42 in the upper area, which are shown as rails. The portrayed supply device 4 comprises two components or rails 43 and 44 in the lower area, on which weaving accessories may be provided in readiness and picked up by the holding element 3. The portrayed receiving device 5 comprises two components or rails 51 and 52 in the upper area and, in the lower area, two rails 53 and 54 onto which the drawn-in weaving accessories can be transferred. In all conceivable embodiments, both the supply device 4 and the receiving device 5 can comprise, independently of each other, a different number of rails or components in general, whose number can range from 1 up to 20, for example.

The first holding element 2 is disposed at a carrier means 6. The complementary holding element 3 is disposed at a carrier means 7. The carrier means 6 and 7 are disposed rotatably around the axis 14. The first holding element 2 and the complementary holding element 3 can transport a pre-tensioned heald at its end loops from the supply device 4 to the receiving device 5. For this purpose, the holding element 3 is disposed movably at the carrier means 7, as is indicated by the bearing axes 17. In order to detension the healds, the holding element 3 can be moved upwards, as per FIG. 1, with the detensioner elements 16, 24. The detensioner element 16 shown on the right in FIG. 1 is configured integrally with a releaser element 12. In this way, a tension-free heald can be transferred by the push-off element 9 of the carrier means 6 and 7 onto a rail 52 and 54 of the receiving device. The push-off elements 9 are shown appropriately in the extended state. The push-off elements 8 are shown in the tensioned, retracted state. In the embodiment shown, the carrier means 6 and 7 first of all rotate from the rails 52 and 54 further to the rails 51 and 53. The carrier means 6 and 7 then pass the stationary device elements 10, which come into engagement with the pretensioning elements 15 and thereby move the push-off elements 9 from the extended state (shown as push-off elements 9) into the tensioned, retracted state (shown as push-off elements 8), as shown in the case of the carrier means 6 and 7 in the left-hand part of FIG. 1.

The releaser elements 12 interact with release elements 11 in order to unlock the push-off elements 8 and thus to allow them to move from the tensioned state (shown as push-off elements 8) into the extended state (shown as push-off elements 9). For this purpose, the releaser elements 12 perform a movement parallel to the axis 14. Each carrier means 6 and 7 is shown with two release elements 11. In other embodiments, the carrier means 6 or 7 may only comprise one release element 11.

Figure 2:
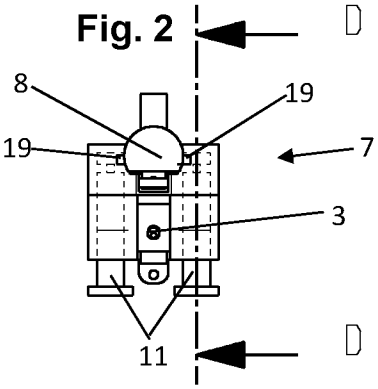
FIG. 2 shows a symbolic front view of an alternative carrier means for a complementary holding element, with partially portrayed obscured edges and a cutting line D:D.

FIG. 2 shows a symbolic front view of an alternative carrier means 7 for a complementary holding element 3. Obscured edges are portrayed in part by broken lines, and a cutting line D:D is shown. The push-off element 8 is shown in the tensioned state. The push-off element is shown to have two lateral guide protrusions 19, which serve to guide the push-off element 8 longitudinally. If appropriately positioned relative to a surrounding groove 18 of the release element 11, the guide protrusions 19 may additionally be used, in combination with the groove, to create a form fit for locking the push-off element 8. The groove 18 of the release element 11 is shown in FIG. 3.

Figure 3:
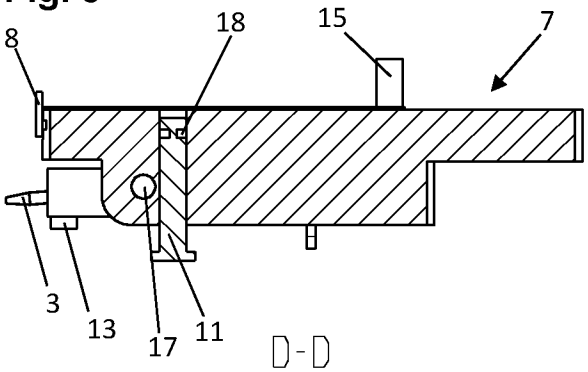
FIG. 3 shows the D:D section through FIG. 2.

FIG. 3 shows the D:D section through FIG. 2. The holding element 3 is disposed movably at the carrier means 7 by means of a bearing axis 17, as shown in FIG. 3. The push-off element 8 is shown in its retracted and tensioned position, into which it was brought with the aid of the pretensioning element 15. FIG. 3 also shows a detensioning pressure element 13, which is arranged at the holding element 3. The release element 11 may be tensioned against the carrier means 7 by a non-depicted spring, so that on retraction of the push-off element 8 a form fit with the release element 11 is created automatically.

Figure 4:
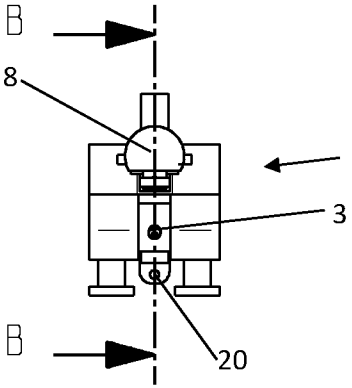
FIG. 4 shows the symbolic view from FIG. 2 with a cutting line B:B but without the obscured edges.
Figure 5:
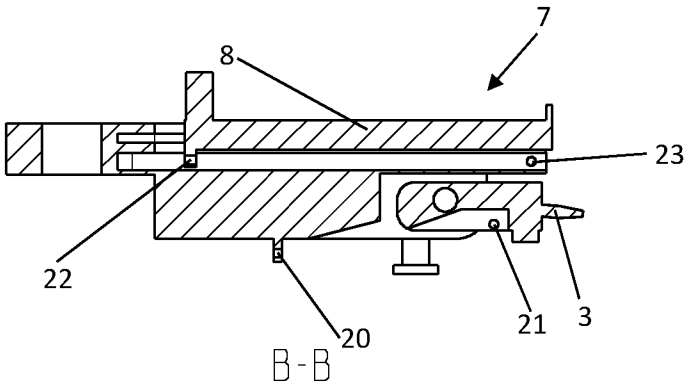
FIG. 5 shows the B:B section through FIG. 4.

FIG. 4 shows the same elements as FIG. 2 except for the broken lines showing obscured edges in FIG. 3. FIG. 4 additionally shows cutting lines B:B. The section through B:B is shown in FIG. 5. In addition to the holding means 3 and the push-off element 8, the carrier means 7 is seen to have a through hole 20. A non-depicted spring may be disposed between the through hole 20 and the pin 21, which is visible in FIG. 4, in order to clamp down the holding element in FIG. 5. In this way, a tensile stress may be applied to a non-depicted weaving accessory if the weaving accessory is additionally arranged at a holding element 2, which is not shown in FIG. 5, above the holding element 3. At one end of the push-off element, a passage 22 is visible. A non-depicted spring may be disposed at the passage 22, and its other end fixed to a securing element 23, in order to trigger a push-off movement of the push-off element 8. The securing element 23 is disposed immovably at the carrier means 7.

Attention is drawn specifically to the fact that, in other embodiments, individual features described above, or all of them, may be solved differently and independently of each other. For example, a form fit between push-off element 8 and release element 11 may be created independently of guide protrusions 19. A different form of longitudinal guiding may also be used, independently of the other features. In particular, any other solution for attaching the springs may be used, as long as the necessary forces and directions of force are ensured.

List of reference numerals

| | |
|---|---|
| 1 | Device |
| 2 | First holding element |
| 3 | Complementary m holding element |
| 4 | Supply device |
| 5 | Receiving device |
| 6 | Carrier means for the first holding element 2 |
| 7 | Carrier means for the complementary holding element 3 |
| 8 | Tensioned push-off element |
| 9 | Extended push-off element |
| 10 | Stationary device element |
| 11 | Release element |
| 12 | Releaser element |
| 13 | Detensioning pressure element |
| 14 | Axis |
| 15 | Pretensioning element |
| 16 | Detensioner element |
| 17 | Bearing axis of holding element |
| 18 | Groove of release element 11 |
| 19 | Guide protrusion of push-off element 8 |
| 20 | Through hole |
| 21 | Pin |
| 22 | Passage |
| 23 | Securing element |
| 41 | Component of supply device 4 |
| 42 | Component of supply device 4 |
| 43 | Component of supply device 4 |
| 44 | Component of supply device 4 |
| 51 | Component of receiving device 5 |
| 52 | Component of receiving device 5 |
| 53 | Component of receiving device 5 |
| 54 | Component of receiving device 5 |

The invention claimed is:

1. A device (1) for handling weaving accessories, the device comprising:

a carrier (6, 7) configured to rotate about an axis (14);

a first holding element (2) for engaging a weaving accessory of the weaving accessories, wherein the first holding element (2) is operably connected to the carrier and rotatable therewith about the axis (14), wherein the first holding element (2) is configured to be moved by the carrier cyclically between a supply device (4) and a receiving device (5) about the axis (14); and a push-off element (8, 9) operably connected to the carrier (6, 7) such that the push-off element (8, 9) is configured to rotate therewith about the axis (14);

wherein the push-off element (8, 9) is configured for pushing a weaving accessory of the weaving accessories off the first holding element (2) and onto a component (51, 52, 53, 54) of the receiving device (5).

2. The device (1) according to claim 1, wherein the axis is a vertical axis and the first holding element (2) follows a circular path about the vertical axis (14).

3. The device (1) according to claim 1, wherein the push-off element (8, 9) comprises a mechanical actuator operably connected to the carrier (6, 7);

wherein the push-off element (8, 9) is movable relative to the carrier (6, 7) via the mechanical actuator.

4. The device (1) according to claim 3, wherein the push-off element (8, 9) comprises a pretensioning element (15), wherein the pretensioning element (15) is configured to allow the push-off element (8, 9) to be moved by a stationary device element (10) into a retracted position relative to the carrier (6, 7) when the carrier (6, 7) is moved past the stationary device element (10) in order to build up a mechanical stress in the mechanical actuator.

5. The device (1) according to claim 4, wherein the push-off element (8, 9) is configured to be temporarily fixed in the retracted position.

6. The device (1) according to claim 5, wherein the carrier (6, 7) comprises a release element (11) configured to be displaced relative to the carrier (6, 7) for releasing the push-off element (8, 9) from the temporarily fixed, retracted position to allow the push-off element (8, 9) to perform a push-off movement driven by the mechanical actuator.

7. The device (1) according to claim 6, further comprising a releaser element (12) movable relative to the carrier (6, 7) along an axis (14) about which the first holding element (2) is movable, the releaser element (12) configured to displace the release element (11) of the carrier (6, 7) when the release element (11) is positioned at the component (51, 52, 53, 54) of the receiving device.

8. The device (1) according to claim 1, further comprising a detent of the carrier (6, 7) which is configured to oppose a push-off movement of the push-off element (8, 9) when the push-off element (8, 9) is in an extended position to force the push-off element (8, 9) back from the extended position.

9. The device (1) according to claim 1, further comprising a complementary holding element (3) corresponding to the first holding element (2) and spaced therefrom along an axis (14) about which the first holding element (2) is movable, wherein the first holding element (2) and/or the complementary holding element (3) is movable relative to the carrier (6, 7) to allow the weaving accessory of the weaving accessories to be held under tensile stress between the first holding element (2) and the complementary holding element (3).

10. The device (1) according to claim 9, wherein a distance between the first holding element (2) and the complementary holding element (3) along the axis (14) is adjustable.

11. The device (1) according to claim 9, wherein the complementary holding element (3) is configured to be displaced by at least one detensioner element (16, 24), which is movable in a direction of the axis (14), when the carrier (6, 7) is located at a component (41, 42, 43, 44) of the supply device (4) or at the component (51, 52, 53, 54) of the receiving device (5).

12. The device (1) according to claim 1, wherein the carrier (6) of the first holding element (2) is operably connected to a shaft that extends along an axis (14) about which the first holding element (2) is movable.

13. A method for the handling of weaving accessories, the method comprising:

cyclically moving a carrier (6, 7) and a first holding element (2) operably connected thereto between a supply device (4) and a receiving device (5) about an axis (14); and pushing off a weaving accessory of the weaving accessories held on the first holding element (2) onto a component (51, 52, 53, 54) of the receiving device (5) with a push-off element (8, 9) that is operably connected to the carrier (6, 7), wherein the push-off element (8, 9) cyclically moves together with the carrier (6, 7) and the first holding element (2) between the supply device (4) and the receiving device (5).

14. The method according to claim 13, wherein the first holding element (2) moves along a circular path about the axis (14).

15. The method according to claim 13, further comprising moving the carrier (6, 7) of the first holding element (2) past a stationary device element (10) in order to displace the push-off element (8, 9) relative to the carrier (6, 7).

16. The method according to claim 13, further comprising:

moving a releaser element (12) along a direction of the axis (14) relative to the carrier (6, 7) when the carrier (6, 7) is positioned at the component (51, 52, 53, 54) of the receiving device (5); and displacing a release element (11) which is operably connected to the carrier (6, 7) relative to the carrier (6, 7) so that the push-off element (8, 9) pushes off the weaving accessory of the weaving accessories held on the first holding element (2, 3) onto the component (51, 52, 53, 54) of the receiving device (5).

* * * * *